United States Patent [19]

Birkenfeld et al.

[11] Patent Number: 4,724,658

[45] Date of Patent: Feb. 16, 1988

[54] ARRANGEMENT FOR SLIDING AND SHRINKING A HOOD OF SHRINKING FOIL OVER AND ONTO A STACK

[75] Inventors: Richard Birkenfeld, Beckum; Olaf Klüpfel, Ahlen-Vorhelm; Manfred Grünert, Beckum, all of Fed. Rep. of Germany

[73] Assignee: Möllers Maschinenfabrik GmbH, Beckum, Fed. Rep. of Germany

[21] Appl. No.: 38,784

[22] Filed: Apr. 15, 1987

[30] Foreign Application Priority Data

Jun. 25, 1986 [DE] Fed. Rep. of Germany ..... 3621297

[51] Int. Cl.[4] ..... B65B 9/10; B65B 53/06

[52] U.S. Cl. ..... 53/557; 53/567; 53/442

[58] Field of Search ..... 53/557, 567, 442, 459, 53/585

[56] References Cited

U.S. PATENT DOCUMENTS

| | | | |
|---|---|---|---|
| 3,925,964 | 12/1975 | Birkenfeld | 53/567 |
| 4,473,990 | 10/1984 | Thimon | 53/567 |
| 4,575,989 | 3/1986 | Hannen | 53/557 X |

FOREIGN PATENT DOCUMENTS

| | | | |
|---|---|---|---|
| 2565554 | 12/1985 | France | 53/557 |
| WO82/03833 | 11/1982 | PCT Int'l Appl. | 53/557 |
| 88424 | 9/1983 | European Pat. Off. | 53/557 |

*Primary Examiner*—John Sipos

*Attorney, Agent, or Firm*—Toren, McGeady & Associates

[57] ABSTRACT

An arrangement for sliding and shrinking a hood of shrinking foil over and onto a stack formed by a number of packaging objects. The arrangement includes a vertically movable frame with shrinking devices provided in the upper region of the frame and gripping elements for grasping and pulling down the lower edge of the shrinking foil. A lifting device arranged centrically underneath the stack serves to raise the stack from a conveying device which transports the stack into and out of the arrangement according to the invention. The lifting device raises the stack so that the lower edge of the hood of shrinking foil can be shrunk onto the stack up to the region of the conveying device. Subsequently, the lifting device is lowered. The vertical distance between the gripping elements and the shrinking devices is adjustable.

5 Claims, 3 Drawing Figures

ARRANGEMENT FOR SLIDING AND SHRINKING A HOOD OF SHRINKING FOIL OVER AND ONTO A STACK

BACKGROUND OF THE INVENTION

1. Field of the Invention

The present invention relates to an arrangement for sliding and shrinking a hood of shrinking foil over and onto a stack formed by a number of packaging objects. The arrangement includes a vertically movable frame with shrinking devices provided in the upper region of the frame and gripping elements for grasping and pulling down the lower edge of shrinking foil.

2. Description of the Prior Art

Arrangements of the afore-described type are known, e.g., WO No. 82/03833. Compared to arrangements including a device for sliding a hood of shrinking material over a stack and a subsequent shrinking apparatus, they have the advantage that their operation is faster because no transfer times from the hood sliding device to the shrinking device are required. In addition, it is possible to save the times usually required for retracting the gripping elements used for sliding the hood over the stack in the separate hood sliding device and, if a shrinking frame which can be raised and lowered is used, for returning this frame after the shrinking procedure has been concluded. This is because in a combined arrangement of the aforementioned type, the shrinking foil hood can be slid over the stack when the vertically movable frame is lowered and the shrinking procedure can be performed when the frame is again raised or retracted.

In accordance with other known arrangements, e.g., EP No. 0 077 508, the hood of shrinking foil can especially well shrunk onto the underside of the stack. In these arrangements, the stack is raised during the sliding of the hood over the stack and then placed down again after the lower edge of the hood has been turned in and shrunk on. As a result, the lower edge of the hood of the shrinking foil which has been turned in and shrunk on remains fixed during the further shrinking of the side surfaces of the hood. In other words, when the foil becomes shorter during the shrinking procedure of the side surfaces, the bottom edge of the hood cannot be pulled away again from the bottom side of the stack.

It is, therefore, the primary object of the present invention to provide an arrangement of the afore-described type in which the two above-described known devices are combined in a single arrangement in such a way that the structural height of the combined arrangement does not increase.

SUMMARY OF THE INVENTION

In accordance with the present invention, the arrangement of the afore-described types includes a lifting device arranged centrically underneath the stack. The lifting device serves to raise the stack from a conveying device which transports the stack into and out of the arrangement according to the invention. The lifting device raises the stack so that the lower edge of the hood of shrinking foil can be shrunk onto the stack up to the region of the conveying device. Subsequently, the lifting device is lowered again. In principle, the arrangement of a lifting device in conjunction with a station for sliding a hood of shrinking foil onto a stack and for turning the lower edge of the hood is known from EP No. 0 077 508. In addition, the arrangement according to the invention includes gripping elements for the foil as well as shrinking devices. The arrangement further includes a vertically movable frame with means for providing a vertical relative movement between the gripping elements and the shrinking devices.

The arrangement according to the invention makes it possible that in the uppermost position of the vertically movable frame, the shrinking devices and the gripping elements between the stack and the devices arranged above the stack, such as, gripping devices for opening and keeping open the hose of shrinking foil, requires relatively little space during the procedure of sliding on the hose. In addition, in the lower position of the vertically movable frame, the gripping elements for sliding the lower edge of the hood of shrinking foil over the stack can be moved further downwardly out of the range of operation of the shrinking devices, or have already been moved prior to the downward movement of the vertically movable frame, so that, after the hood of shrinking foil has been slid over the stack, the gripping element can be separated from the hood and that, on the other hand, when the shrinking devices are put in operation, the gripping elements are not in the way for effecting a satisfactory shrinking of the hood at the bottom side of the stack after the stack has been raised by means of the lifting device. The space available for raising the stack by means of the lifting device is equal to the space required for securely grasping the lower edge of the hood of the shrinking foil in the lowered position of the stack by means of the gripping elements arranged on the vertically movable frame.

In accordance with a particularly simple embodiment of the present invention, the gripping elements are constructed vertically movably relative to the vertically movable frame.

It is advantageous if the gripping elements can be raised and lowered within certain limits along appropriate vertical guides on the common frame by means of at least one pneumatic or hydraulic drive cylinder.

Since the structural height of the entire arrangement according to the invention is relatively low, a further development of the invention provides that a heat shield is arranged in order to prevent heat generated during the operation of the shrinking devices from prematurely softening the shrinking foil made available above the stack for the next procedure of sliding on the shrinking foil. Such a heat shield is basically already known from simple shrinking devices which operate with a flow of cold air, as described in German Gebrauchsmuster No. 85 13 892. In accordance with the present invention, the heat shield is provided between the vertically stationary upper gripping devices for opening and keeping open the hose during sliding the hose over the stack and the vertically movable frame in its uppermost position.

In accordance with a particularly advantageous embodiment of the invention, the heat shield includes two sliding plates which can be horizontally moved from an ineffective position on the side to a shielding position in which the plates contact one another.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
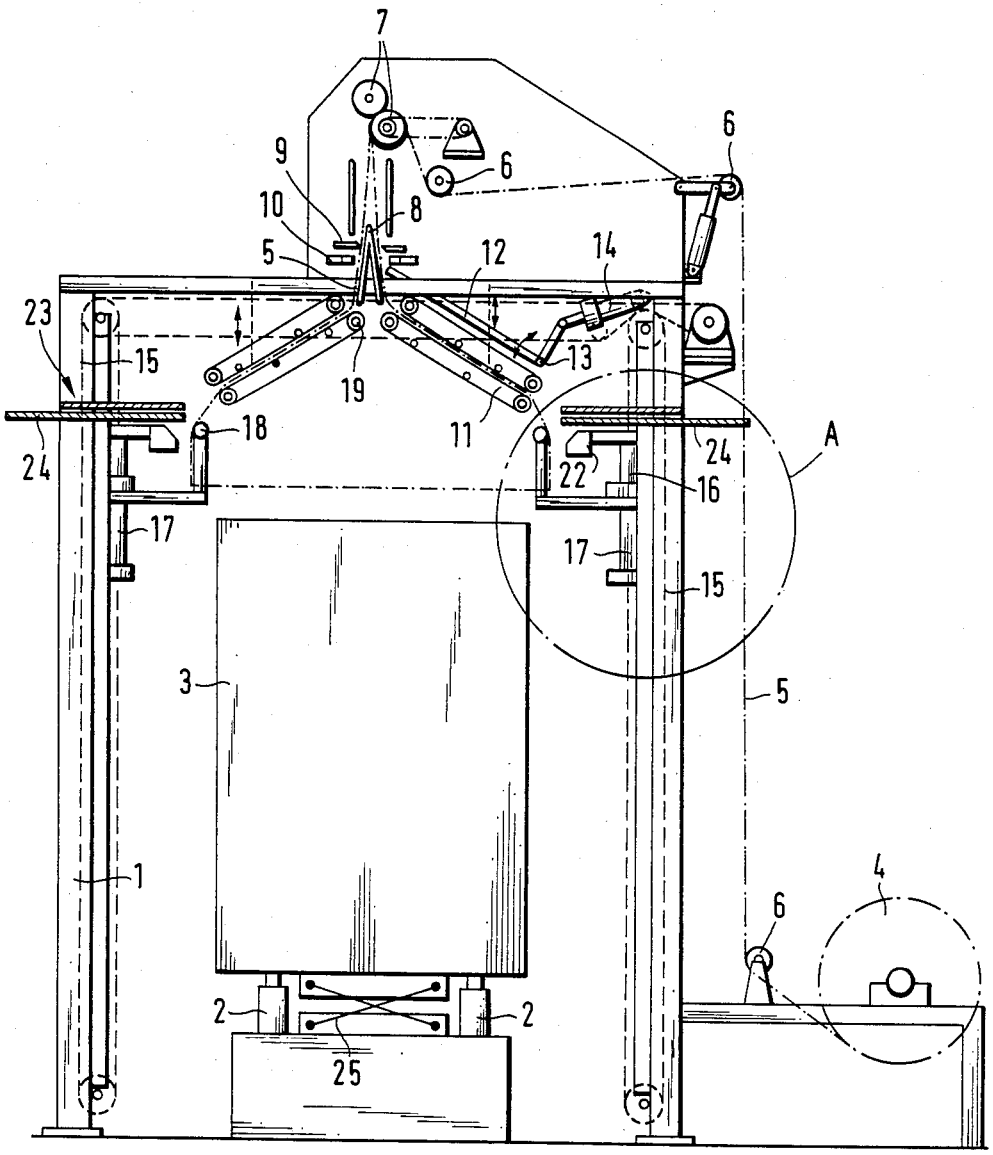
FIG. 1 is a side elevational view of the arrangement according to the invention, illustrating the vertically movable frame in the uppermost position, the stack in the lowered position and the heat shield in the ineffective position.
Figure 2:
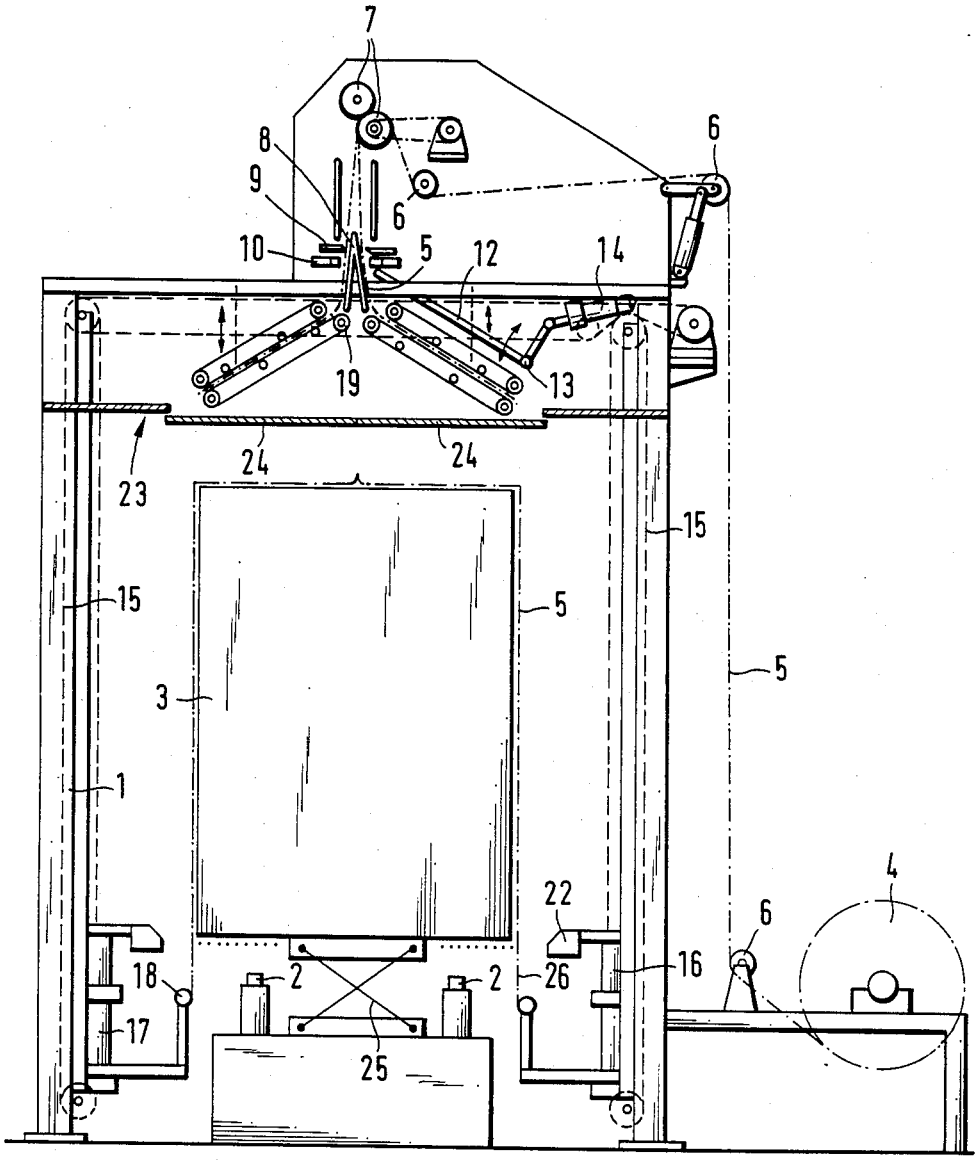
FIG. 2 is a side elevational view of the arrangement of FIG. 1, illustrating the vertically movable frame in the lowermost position, the gripping elements in the lowermost position, the stack in the raised position by means of the lifting device and the heat shield in the shielding position.
Figure 3:
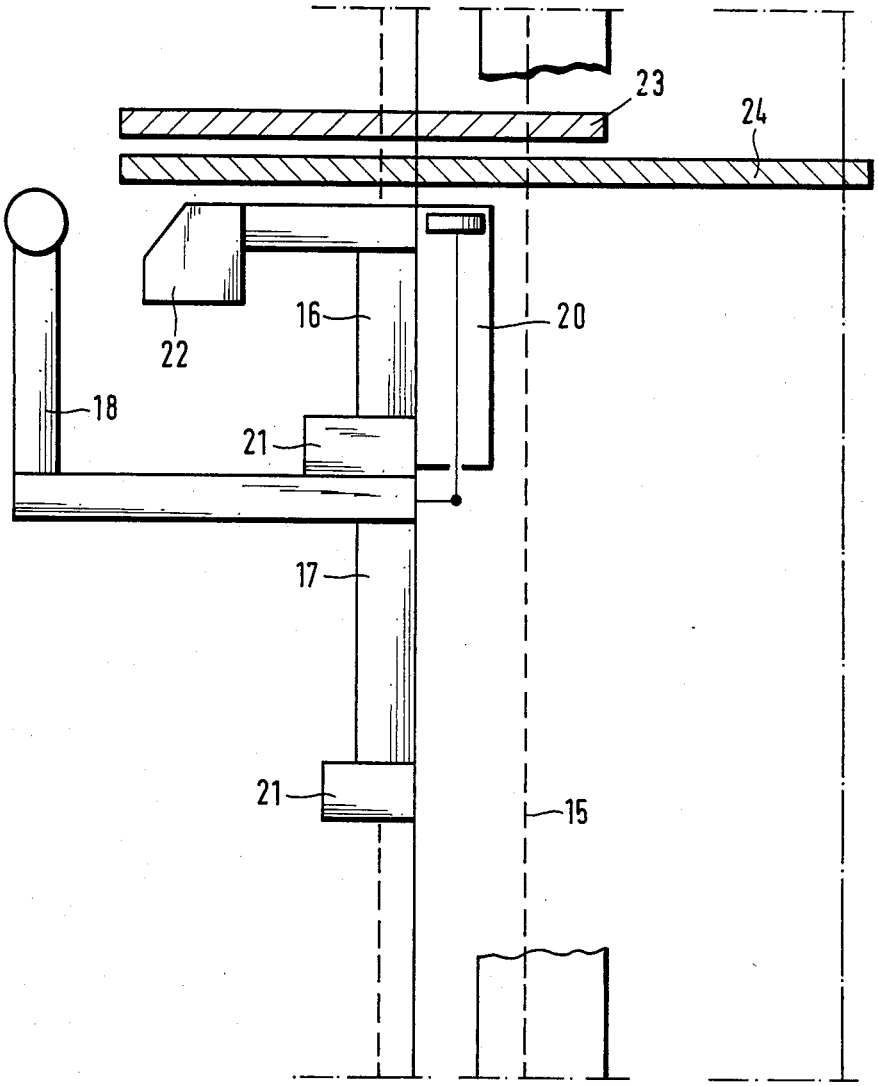
FIG. 3 shows, on a larger scale, a detail A from FIG. 1, illustrating an actuating device for the gripping element.

As illustrated in FIGS. 1 and 2 of the drawing, a schematically shown stack 3 of objects is placed on a track 2 within a stand 1. The stand includes a roller 4 on which a hose of plastics material with folded-in sides is wound. The plastics material of the hose is heat-shrinkable material. The hose 5 is supplied in the flat state over deflection rollers 6 and drive rollers 7 to a prespreading device.

The prespreading device includes guide elements 8 arranged vertically movably in the range of the folded-in sides of the hose. A separating device 9 and a welding device 10 are arranged underneath guide elements 8. Two double conveyor belts 11 are arranged underneath the guide elements 8 on both sides of the stand 1. The double conveyor belts 11 are arranged relative to each other in a roof-like configuration, the upper receiving ends of the belts 11 being located immediately below the guide elements 8 when the guide elements 8 are in the lowered position.

The double conveyor belts 11 can be pivoted about upper pulley axes 19 of the lower conveyor belts, so that the spacing between the discharge end of the two double conveyor belts 11 can be changed in order to adjust it to the different possible cross-sectional sizes of the stack 3. Each double conveyor belt 11 includes a pivot lever 12 arranged approximately parallel to the double conveyor belt and pivotable about a lower fixed point 13 by means of an actuating device 14.

Stand 1 includes in the vicinity of each of the four corners thereof essentially vertically extending endless chains 15. The chains 15 serve to vertically move a frame 16. In each of its four corner regions, the frame 16 includes a vertical guide 17 along which a gripping element 18 can be vertically moved by means of a drive cylinder 20 between two stop members 21.

Frame 16 includes above the vertical guide 17 a circumferentially extending rectangular burner 22 which, in a manner not illustrated in detail, is capable of directing hot gases in direction toward stack 3.

Underneath the double conveyor belt 11 is arranged a heat shield 23 which essentially includes two sliding plates 24. The plates 24 can be moved horizontally from the ineffective position on the sides illustrated in FIG. 1 into the closed position in accordance with FIG. 2.

Finally, between track 2 formed by chain conveyors is arranged a lifting device 25 by means of which the stack 3 can be raised from the position resting on track 2 according to FIG. 1 to the raised position according to FIG. 2.

The arrangement according to the present invention operates as follows.

The hose 5 is opened by guide elements 8 and double conveyor belts 11 and, after the lower end of the hose has been conveyed a certain distance past the double conveyor belts 11, the gripping elements which have been slightly pivoted inwardly are inserted into the hose and are then moved outwardly, so that the hose is tightly held between the gripping elements 18 located at the four corners of the stack, as illustrated in FIG. 1.

Subsequently, the double conveyor belts 11 and the chains 15 are actuated and the hose is pulled a certain distance over the stack 3. The guide elements 8 are then moved upwardly and the welding and separating devices 9 and 10 are actuated. Subsequently, the double conveyor belts 11 are again put into operation and, simultaneously, pivot levers 12 are pivoted downwardly, so that the folded-in sides of the hose are pushed or pulled out of the receiving ends of the double conveyor belts 11. Simultaneously, frame 16 with gripping elements 18 and burners 22 are moved further downwardly until the stack 3 is fully surrounded by the hose which now forms a hood.

Before or during the downward travel of frame 16, stack 3 is raised by means of lifting device 25 and gripping elements 18 are moved downwardly along vertical guide 17, as shown in FIG. 2, so that the gripping elements 18 are pulled out of the hose. The lower edge 26 of the hood now hangs a certain distance below the lower end of the stack 3.

After the hose has been fully pulled over the stack, the two sliding plates 24 of heat shield 23 are moved together, as illustrated in FIG. 2, so that the heat generated during the subsequent actuation of the burner cannot soften in a disadvantageous manner the portion of the hose 5 located above the stack before it is being slid over the stack.

The burner 22 is now switched on. In the position illustrated in FIG. 2, the burner 22 is directed in such a way that the lower edge 26 of the hose is blown against the bottom side of the stack and is simultaneously shrunk onto the bottom side of the stack, as shown in dotted lines in FIG. 2. The lifting device 25 is then actuated in order to lower stack 3, so that the folded-in lower edge 26 is fixed between stack 3 and track 2. Simultaneously with or shortly after the lowering of the stack 3, frame 16 is again moved upwardly, so that burner 22 proceeds to shrink the side surfaces of hose 5 against the stack 3.

At the conclusion of the upward movement of frame 16, drive cylinder 20 is actuated for moving the gripping elements 18 upwardly, so that the frame again assumes the initial position for a new work cycle, as illustrated in FIG. 1.

Depending upon the type of stack 3, it may be advantageous, after having shrunk-on and fixed the lower edge 26 of the hose, to initially raise frame 16 without the burner 22 being in operation, so that shrinking is performed from top to bottom in order to permit air within the stack to escape as much as possible.

Of course, the above-described arrangement can be modified without leaving the basic concept of the present invention. For example, the gripping devices arranged above the vertically movable frame for opening and keeping open the hose during the movement of sliding on the hose can be constructed differently or entirely omitted. This can be done if it is acceptable in certain types of stacks that the hose slides along the upper edges of the stack when the hose is slid over the stack. Also, instead of a burner, other shrinking devices, such as, infrared units, may be arranged on the vertically movable frame.

While the specific embodiment of the invention has been shown and described in detail to illustrate the application of the inventive principles, it will be understood that the invention may be embodied otherwise without departing from such principles.

We claim:

1. An arrangement for sliding and shrinking a hood of shrinking foil over and onto a stack formed by a number of packaging objects, comprising a vertically movable frame having upper and lower portions, shrinking devices mounted in the upper portion of the frame and gripping elements mounted in the lower portion of the frame for grasping and pulling down the lower edge of the shrinking foil, a lifting device placed centrically underneath the stack, a conveying device for transporting the stack into and out of the arrangement, the lifting device capable of raising the stack from the conveying device so that the lower edge of the hood of the shrinking foil can be shrunk onto the stack up to the region of the conveying device, and the lifting device capable of subsequently lowering the stack, means for changing the vertical distance between the gripping elements and the shrinking devices on the vertically movable frame during operation of the gripping elements.

2. The arrangement according to claim 1, wherein the gripping elements are vertically movable relative to the vertically movable frame.

3. The arrangement according to claim 2, wherein the vertically movable frame includes vertically extending guides and a pneumatic or hydraulic drive cylinder for raising and lowering the gripping elements along the guides, the frame further comprising stop means for limiting the vertical movement of the gripping elements.

4. The arrangement according to claim 1, comprising a heat shield located between vertically stationary upper gripping means for opening and keeping open the hood of shrinking foil when the hood is slid over the stack and the vertically movable frame when the frame is in its uppermost position.

5. The arrangement according to claim 4, wherein the heat shield comprises two sliding plates which can be horizontally moved from an ineffective position on the side to a shielding position in which the plates contact one another.

* * * * *